US006223373B1

(12) United States Patent
Yeh

(10) Patent No.: US 6,223,373 B1
(45) Date of Patent: May 1, 2001

(54) PLIERS

(76) Inventor: Shih-Yuan Yeh, No. 260, Chen-Fu Rd., Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/437,852

(22) Filed: Nov. 10, 1999

(51) Int. Cl.[7] ..... B25B 7/22

(52) U.S. Cl. ..... 7/127; 7/137; 7/144; 81/451; 81/427.5

(58) Field of Search ..... 7/127, 129, 137, 7/144; 81/427.5, 177.4, 490, 439, 451

(56) References Cited

U.S. PATENT DOCUMENTS 2,829,685 * 4/1958 Mitchell et al. ..... 81/451
3,739,825 * 6/1973 Knox .
4,336,832 * 6/1982 Poulos .
4,953,248 * 9/1990 Trombetta ..... 7/127 X
5,014,379 * 5/1991 Hull et al. ..... 7/127
5,033,140 * 7/1991 Chen et al. ..... 7/127
5,251,353 * 10/1993 Lin ..... 7/128
5,910,174 * 6/1999 Finn ..... 7/127

FOREIGN PATENT DOCUMENTS

460470 * 5/1928 (DE) ..... 81/451

* cited by examiner

*Primary Examiner*—D.S. Meislin
(74) *Attorney, Agent, or Firm*—Thorp Reed & Armstrong

(57) ABSTRACT

A pair of pliers with multiple functions is disclosed. The pliers have a pair of shanks pivotally engaged with each other each having a jaw formed at one end thereof, a polygon hole defined in the other end to hold a tool head, a hammer formed on the outside of one of the jaws and a chisel formed on the other. In addition, teeth and a cutting edge are formed on the face of the corresponding jaws or shanks. Consequently, the pair of pliers can be used as a hammer, a chisel or a screwdriver. This can improve the flexibility of the pair of pliers.

5 Claims, 4 Drawing Sheets

PLIERS

BACKGROUND OF THE INVENTION

1. Field of the Invention

The present invention relates to a pair of pliers, and more particularly to a pair of pliers with multiple functions including a hammer, a chisel and a screwdriver.

2. Description of Related Art

Pliers in accordance with the prior art comprise a pair of shanks pivotally engaged with each other at a pivot point away from one end. A jaw is formed on one end of each shank to cut or hold an object. However, because the conventional pliers can only be used to hold or cut an object, it lacks versatility. Conventional pliers comprising a pair of hollow shanks with a recess formed therein for pivotally mounting tools such as blades, scissors, or screwdrivers etc. do exist so as to improve the utilization of the pliers. Even though the conventional pliers with multiple tools have multiple functions, but it cannot bear a large load when the user grips the shanks.

To overcome the shortcomings, the present invention tends to provide pliers with multiple functions to mitigate or obviate the aforementioned problems.

SUMMARY OF THE INVENTION

The main objective of the invention is to provide pliers having a pair of pivotal shanks with a jaw formed on one end of each corresponding shank. Teeth and a cutting edge are formed on the face of each jaw or shank. A hammer and a chisel are formed on the outside of opposite jaws so that the pliers can be used in a hammer or a chisel, and a polygon hole is formed in the other end of each of the shanks to insert a tool head like as screwdriver. Consequently, this can improve the utility of the pliers.

Other objects, advantages and novel features of the invention will become more apparent from the following detailed description when taken in conjunction with the accompanying drawings.

DETAILED DESCRIPTION OF PREFERRED EMBODIMENT

Figure 1:
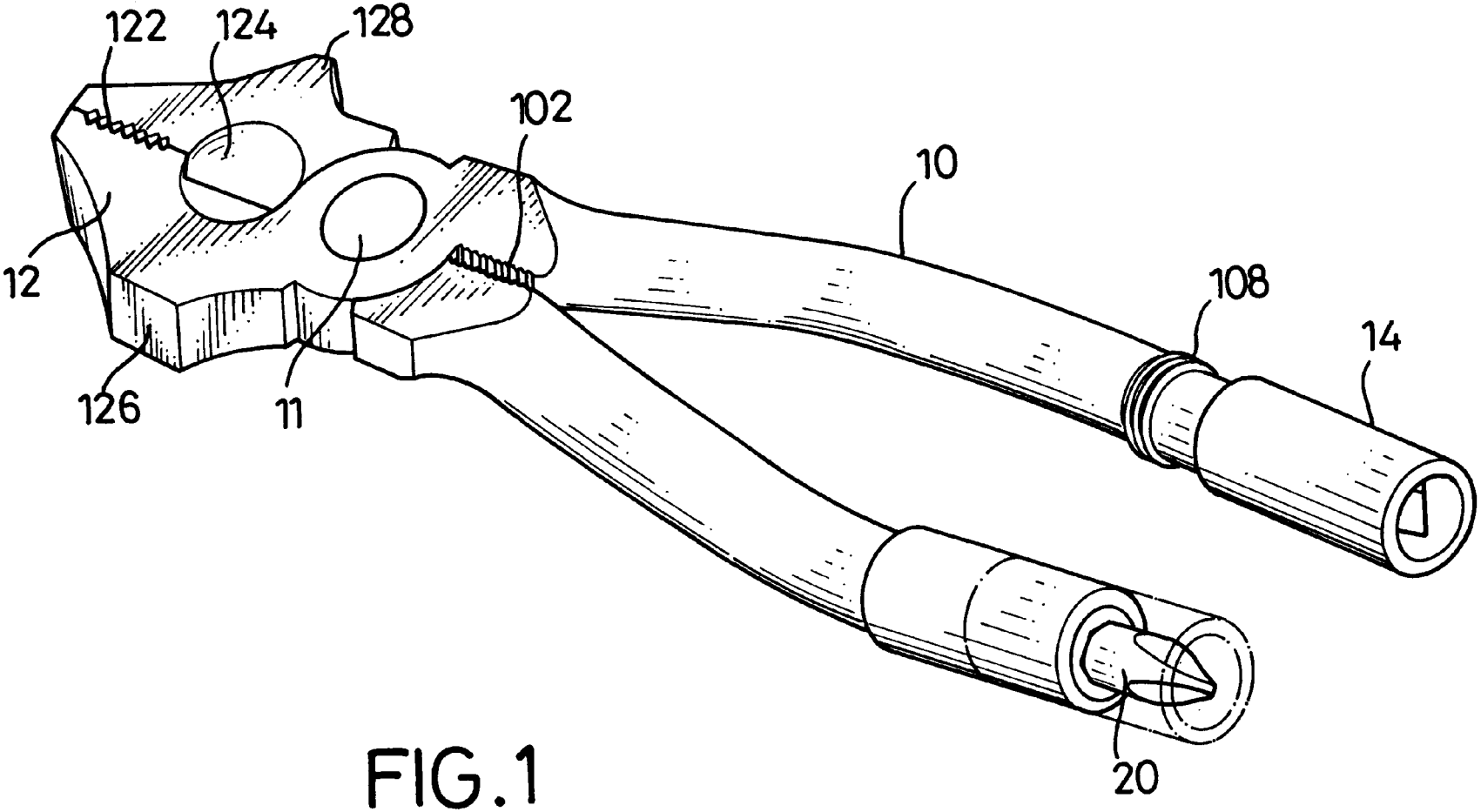
FIG. 1 is a perspective view of a pair of pliers in accordance with the present invention.

Referring to FIG. 1, a pair of pliers in accordance with the present invention comprises a pair of shanks (10) pivotally engaged with each other by means of a pivot (11). A jaw (12) is formed on corresponding faces at one end of each shank (10). Each jaw (12) has teeth (122) and a cutting edge (124) formed on the inside face. The pair of pliers can hold a member and rotate it with the cooperation of the corresponding teeth (122) formed on the pair of jaws (12) or cut an object like a wire with the cutting edges (124). A second set of teeth (102) is formed on the corresponding faces of each shank (10) on the other side of the pivot (11) so as to hold an object between the corresponding teeth (102).

A hammer (126) is formed on the outside of one of the pair of jaws (12), such that the pair of pliers can be used as a hammer. A chisel (128) is formed on the outside of the other one of the pair of jaws (12). With such an arrangement, the pair of pliers can be used as a hammer or a chisel, and the multiple functions of the pair of pliers can be achieved.

Figure 2:
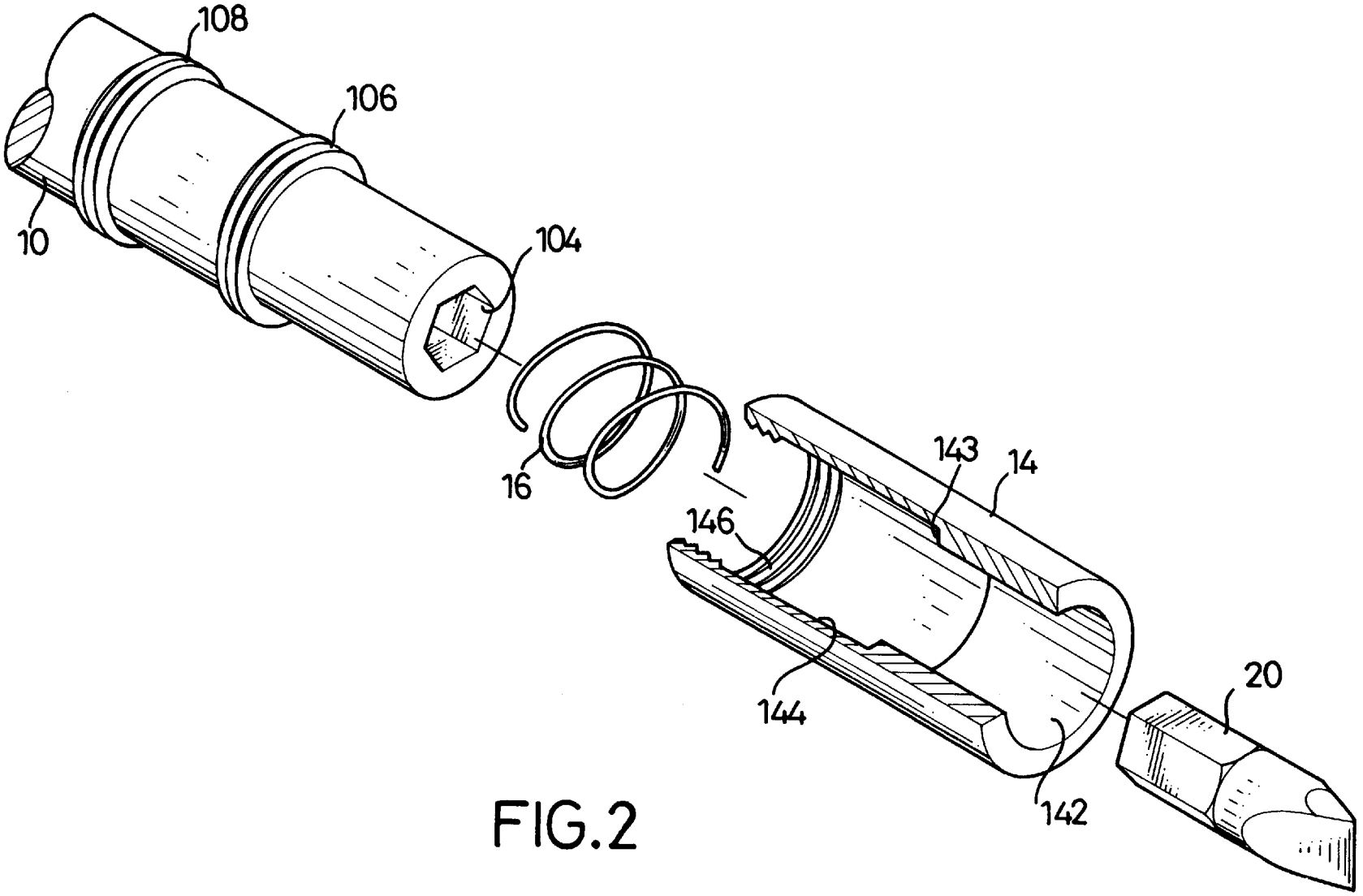
FIG. 2 is a partial exploded perspective view of the pair of pliers in FIG. 1.
Figure 3:
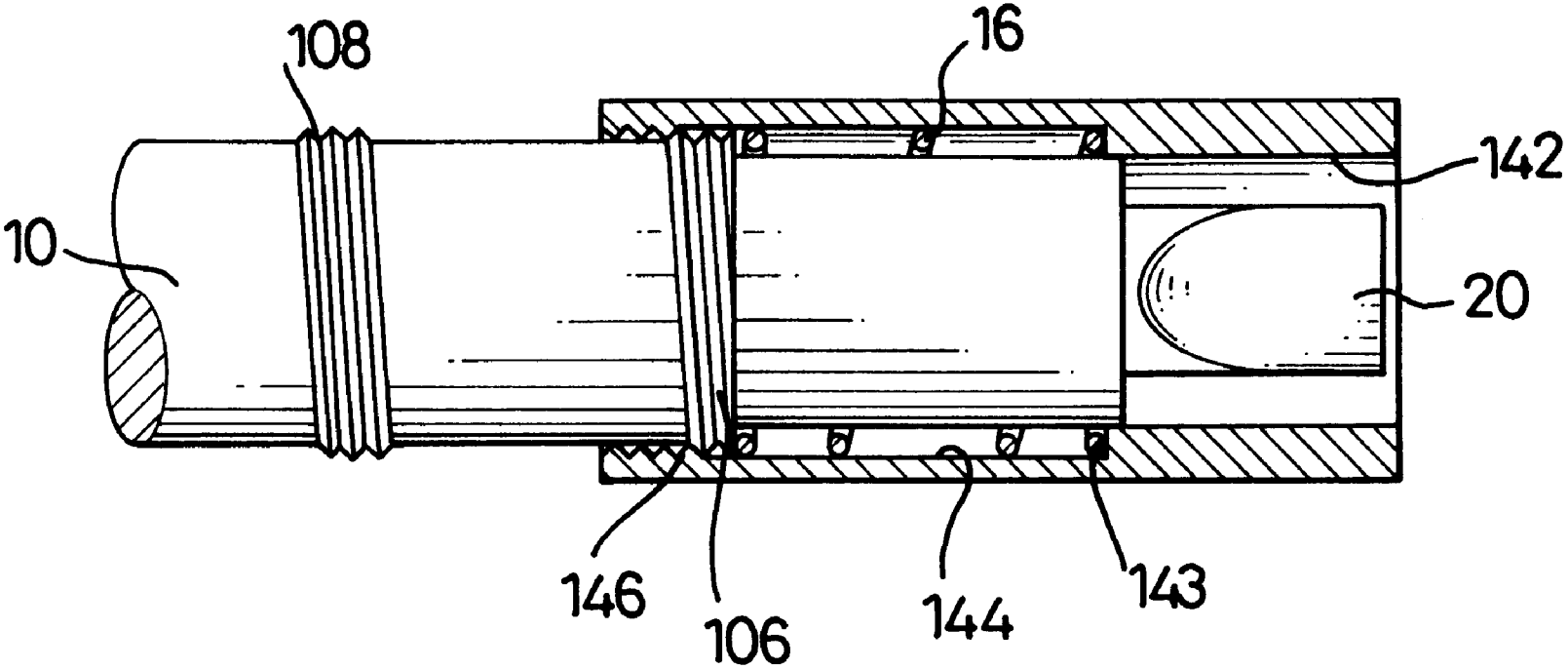
FIG. 3 is a partial plan view in partial section of the pair of pliers in FIG. 2.

Referring to FIGS. 1–3, a polygonal hole (104) is defined in the end of each shanks (10) away from the jaws (12). A tool head (20) like a screwdriver head with a polygonal end can be inserted into and received within the hole (104), such that the pair of pliers with tool head (20) mounted on the distal end thereof is able to be used as a screwdriver. A sleeve (14) with a longitudinal through hole (142) is slidably and rotatably mounted on the end of each shank (10) with the hole (104) receiving the tool head (20) therein. A biasing member (16), such as a coil spring, is located between the one of the corresponding ends of the shanks (10) and the sleeve (14). A recess (144) is defined in the face defining the through hole (142) to receive the biasing member (16), and a shoulder (143) is formed at the conjunction of the through hole (142) and the recess (144) to abut one end of the biasing member (14). A first thread (106) is formed near the end with the hole (104) on the outside of each shank (10), such that the other end of the biasing member (16) can abut the first thread (106). Furthermore, a second thread (108) is formed on each shank (10) with a separation from the first thread (106). An inner thread (146) is formed in the sleeve (14).

Figure 4:
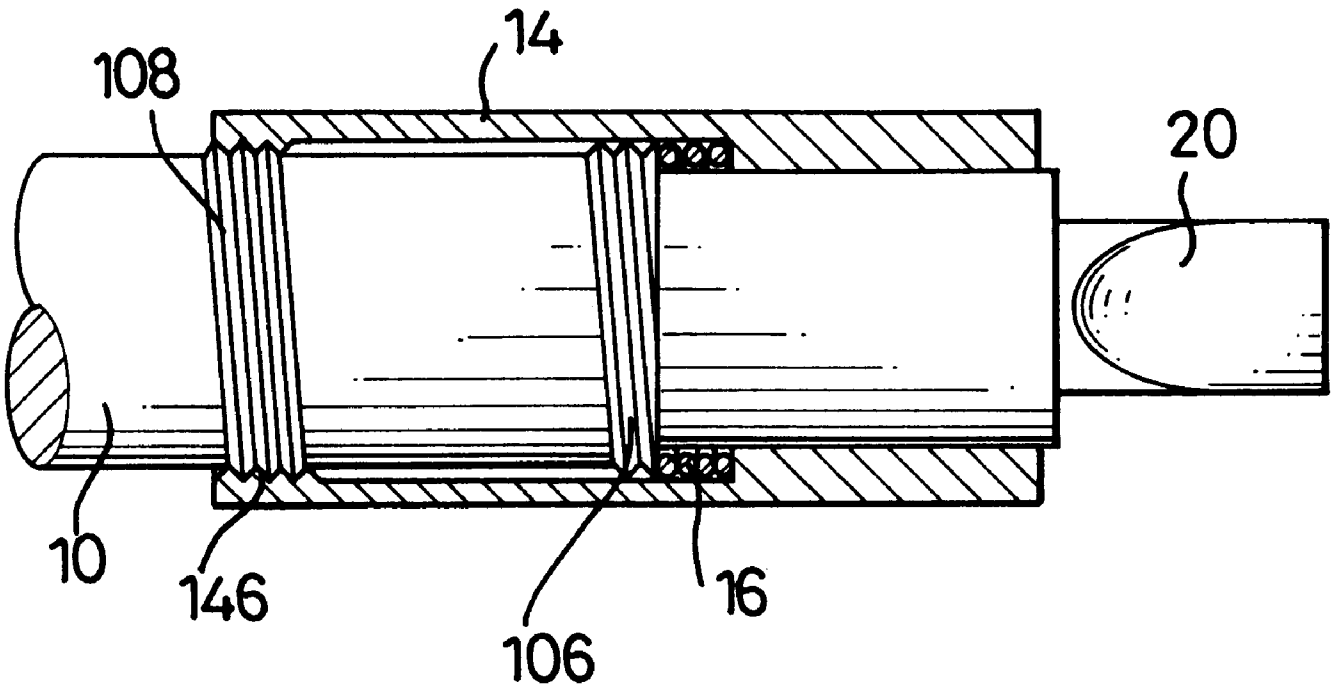
FIG. 4 is a operational partial plan view in partial section of the pair of pliers in FIG. 2.

Referring to FIG. 3, the inner thread (146) of the sleeve (14) can screw over the first thread (106) of the shank (10) and abut thereto. The sleeve (20) will be limited by the first thread (106) to avoid becoming disconnected from the shank (10). In operation, referring to FIG. 4, the sleeve (14) can be slid along the shank (10) to expose the tool head (20). Furthermore, the sleeve (14) can be rotated relative to the corresponding shank (10), and the inner thread portion (146) will screw onto the second thread (108) of the shank (10) such that the sleeve (14) can be positioned on the shank (10) to expose the tool head (20), and the user can screw an object like a bolt by the tool head (20) as rotating the pair of pliers. Therefore, the pair of pliers can be used as a screwdriver. In addition, because the shanks (10) are solid bodies, the pair of pliers can bear a large load.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pair of pliers comprising:

a first and second shank pivotally engaged with each other by a pivot, each shank having a jaw formed on a first end and a polygonal hole defined in a second end opposite to the first end to hold a tool head;

a hammer formed on an outside of one of said jaws and a chisel formed on the other;

a sleeve slidably and rotatably mounted on said second end of each shank and having a longitudinal through hole; and a biasing member located between each shank and sleeve, wherein a first thread and a second thread are separately formed on each shank, and an inner thread is formed in each sleeve to screw onto one of the first or second threads on said shank.

2. The pair of pliers as claimed in claim 1, wherein a recess is defined in each sleeve for receiving said biasing member, and a shoulder is formed at a conjunction of said through hole and said recess to abut said biasing member.

3. The pair of pliers as claimed in claim 1, wherein a first set of teeth is formed on a face of each jaw.

4. The pair of pliers as claimed in claim 1, wherein a cutting edge is formed on a face of each jaw.

5. The pair of pliers as claimed in claim 3, wherein a second set of teeth is formed on a face on the other side of the pivot of said corresponding jaw of each shank.

* * * * *